United States Patent [19]

Kingston

[11] Patent Number: 4,518,325

[45] Date of Patent: May 21, 1985

[54] AERIFYING DEVICE FOR WHIRLPOOL BATH OR TUB

[76] Inventor: James E. Kingston, 1108 McRae Rd., Arlington, Wash. 98223

[21] Appl. No.: 512,863

[22] Filed: Jul. 11, 1983

[51] Int. Cl.[3] ..... F04B 17/00

[52] U.S. Cl. ..... 417/368; 417/424

[58] Field of Search ..... 417/368, 366, 423 A, 417/423 R, 369, 372, 373, 360, 410, 424

[56] References Cited

U.S. PATENT DOCUMENTS

| | | | |
|---|---|---|---|
| 2,767,904 | 10/1956 | Doyle | 417/424 |
| 2,774,293 | 12/1956 | Jenn | 417/424 |
| 2,822,122 | 2/1958 | Cole | 417/424 |
| 2,822,123 | 2/1958 | Cole | 417/424 |
| 3,220,638 | 11/1965 | Petersen | 417/368 |
| 3,932,070 | 1/1976 | Porter et al. | 417/368 |
| 4,190,396 | 2/1980 | Tomioka et al. | 417/424 |

*Primary Examiner*—Thomas F. Callaghan
*Assistant Examiner*—Peter M. Cuomo
*Attorney, Agent, or Firm*—Ward Brown; Robert W. Beach

[57] ABSTRACT

An electric motor has an upright axial drive shaft carrying a blower at the bottom and a separate fan at the top. The blower supplies a strong flow of air for aerifying water contained in a whirlpool bath or tub and the fan supplies a secondary flow of air for cooling the motor. A housing mounting the motor has a bottom bowl section forming a first plenum for air blown by the blower and a top dome section forming a second plenum for air blown by the fan. The two plenums are substantially sealed from each other so that the fan continues to supply air to cool the motor and maintain it at its designed operating temperature regardless of whether or not the primary air flow is prevented or reduced, such as by an obstruction.

5 Claims, 4 Drawing Figures

AERIFYING DEVICE FOR WHIRLPOOL BATH OR TUB

BACKGROUND OF THE INVENTION

1. Field of the Invention

The present invention relates to a device for supplying a strong flow of air for aerifying water contained in a whirlpool bath or tub.

2. Prior Art

Some known whirlpool baths and tubs have circumferentially spaced air inlet holes positioned below the water level and communicating with a circumferentially extending plenum chamber. An air compressor or blower supplies a strong flow of air to the plenum chamber through appropriate conduits to aerify the water contained in the bath or tub.

One known air compressor or blower marketed for this use has an electric motor mounted upright in a housing. A single blower or fan carried above and driven by the motor draws air through an inlet in the top of the housing. Such air is blown down along the electrical works of the motor to cool it and is discharged from the housing through a horizontally extending outlet tube into the conduit connected to the bath or tub plenum.

If the conduit or the air holes of the bath or tub are obstructed or clogged, the electric motor continues to operate but the flow of air through it is prevented. Consequently, the motor can burn out or at least overheat so as to shorten its life. Similarly, at start-up the aerifying airflow must overcome the substantial back pressure caused by the water in the spa or tub, and during this period the air flow through the motor may be insufficient to keep the motor at its designed operating temperature.

In addition, the water in the bath or tub usually is heated and, when the electric motor is not operating, water vapor can be conveyed through the conduit into the motor. Condensation can occur inside the motor, or at least the motor is subjected to a humid environment that can cause corrosion and shorten the life of the motor.

SUMMARY OF THE INVENTION

The principal object of the present invention is to provide a novel device for supplying a strong flow of air for aerifying water contained in a conventional whirlpool bath or tub, utilizing an electric motor driving a fan or blower but in a form assuring a flow of air through the electrical works of the motor sufficient to maintain it at its designed operating temperature regardless of whether or not the aerifying air outlet is obstructed.

An additional object is to provide such a device in a form assuring that the electrical works of the motor are not subjected to a potentially corrosive humid environment.

A further object is to provide such a device in a compact, simple form easy and inexpensive to manufacture.

These and other objects are accomplished by the aerifying device of the present invention described in detail below.

DETAILED DESCRIPTION

Figure 2:
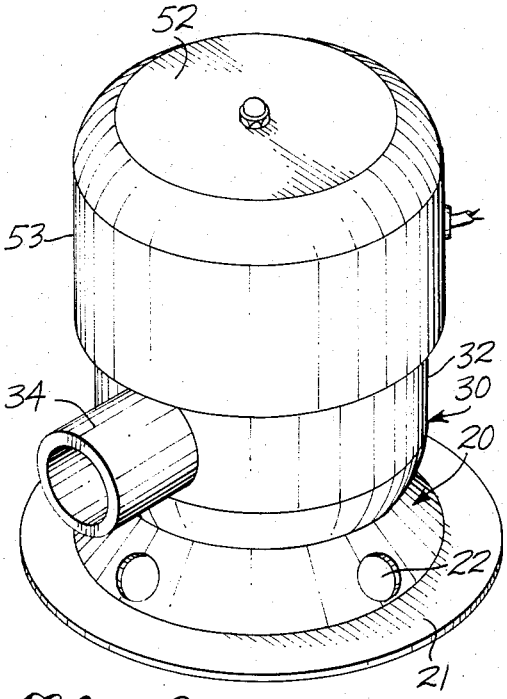
FIG. 2 is a corresponding top perspective of such device with its parts assembled.
Figure 1:
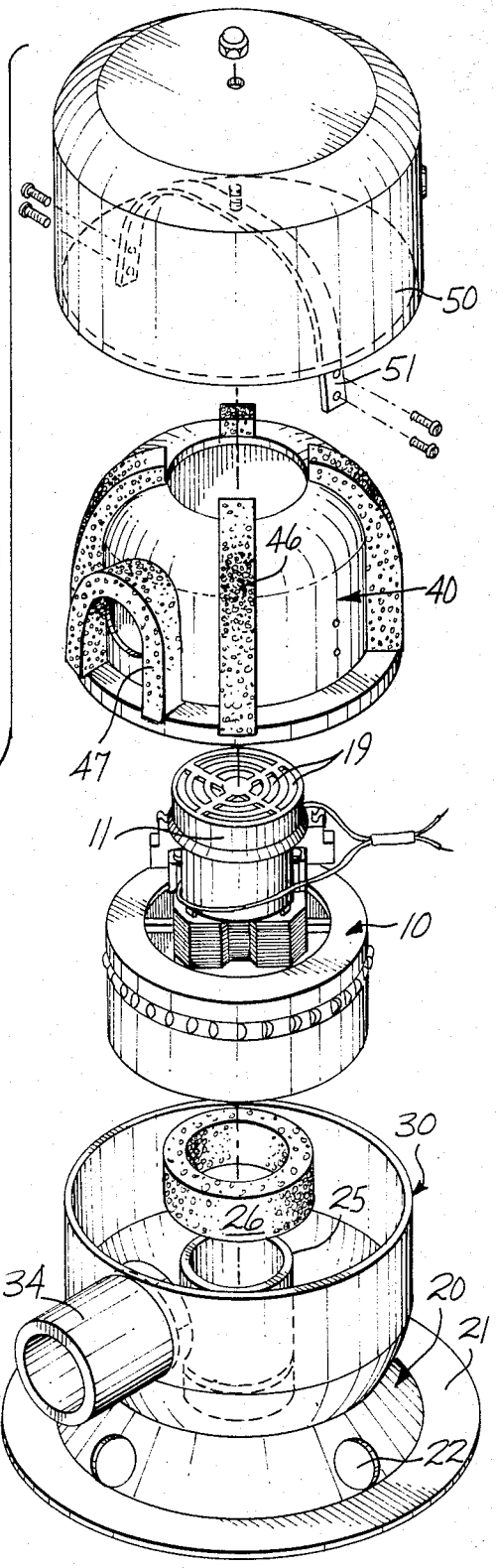
FIG. 1 is an exploded top perspective of an aerifying device for whirlpool baths or tubs in accordance with the present invention.

The aerifying device of the present invention is intended to be used to supply a strong flow of air for aerifying the water in a conventional whirlpool bath or tub. The component parts of such device are best seen in FIG. 1. In general, such device includes an electric motor 10 mounted in a housing having a base 20, a bottom section or bowl 30 and a top section or dome 40. The top of the housing is covered by an upper shroud 50.

It is important for the purposes of the present invention that the electric motor 10 be of a type having separate fans or blowers for supplying, respectively, a primary airflow used to aerify the water in the bath or tub and a secondary airflow for cooling the electrical works of the motor. An example of such a motor is the "Lamb By-Pass Vacuum Motor" sold by Amatek Inc. through its Lamb Electric Division of Kent, Ohio.

Figure 3:
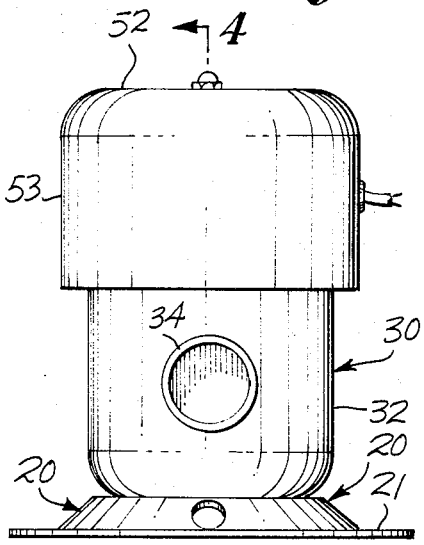
FIG. 3 is a side elevation of such device.

With reference to FIG. 3 which shows such a motor somewhat diagrammatically and partially in section, the electrical works of the motor 10 are enclosed by a cylindrical motor casing 11 and drive an axial shaft 12 carrying a centrifugal blower 13 at one end and propeller-type fan 14 at the other end. The blower 13 is enclosed in a close-fitting blower casing 15 having a central inlet aperture 16 through which air is drawn generally axially into such casing and a row of circumferentially spaced outlet apertures 17 through which such air is blown out of the casing.

The fan 14 is enclosed in a fan casing 18 having air inlet apertures 19 through which air is drawn generally axially inward. Such air is forced through the motor casing 11 along the electrical works of the motor to cool it and then is discharged from the end of the motor casing remote from the fan.

In accordance with the present invention, the motor 10 is mounted with its shaft 12 upright and its main blower 13 at the bottom. A generally frustoconical base 20 has a circumferential horizontal support flange 21 bent outward from the bottom of the generally upright wall 22 which has circumferentially spaced air inlet holes 23. The dished top 24 of the base is bent inward from the top of such upright wall and has a central aperture in which the bottom end portion of an upright air inlet tube 25 is mounted. The bottom end of the air inlet tube is spaced above the bottom of the base 20 to allow a free flow of air into such tube; and the top end of the air inlet tube is sealed to the bottom of the blower casing 15 by a resilient, circular gasket 26 encircling the bottom air inlet aperture 16 of the blower casing.

The dished top 24 of the base supports the generally cylindrical bottom housing section or bowl 30. The bottom 31 of such bowl has a central aperture registered with the aperture of the base 20 and encircling the bottom end portion of the inlet tube 25. The upright peripheral wall 33 of the bowl extends upward to about the top of the blower casing 15 and is spaced outward from the casing outlet apertures 17. The inner end portion of a horizontal, generally radially extending outlet tube 34 is fitted in an aperture in the wall 33 of the bowl 30.

In combination with the blower casing 15, the top of the bowl 30 is closed by the top housing section or dome 40. Such dome has a bottom upright circumferential lip 41 fitted over the upper end portion of the wall 33 of the bowl 30. An annular planar web 42 is bent horizontally inward from such lip 41 and has its inner end portion closely adjacent and sealed to the top of the blower housing 15. The peripheral wall 43 of the dome 40 extends upward from the web 42, is spaced outward from the central portion of the motor 10 and has an air outlet hole 44. The top 45 of the dome is curved inward from the wall 43 and has a central aperture closely encircling and sealed to the fan casing 18.

Figure 4:
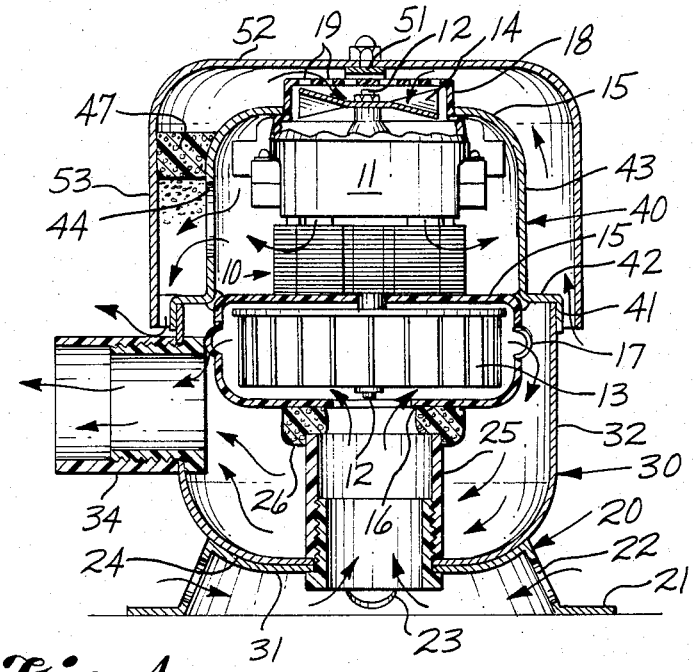
FIG. 4 is a somewhat diagrammatic axial section taken along line 4—4 of FIG. 3.

As best seen in FIG. 1, the top shroud 50 is mounted over the upper housing section or dome 40 by a bracket 51. FIG. 4 shows the horizontal top 52 of such shroud spaced above the apertured top of the fan housing 18 of the electric motor. The upright peripheral shroud wall 53 extends downward from such top 52 to about the lip 41 of the top housing section 40. The wall 53 is spaced outward from the lip 41 to form an annular air inlet passage.

FIG. 4 also illustrates the separate airflows created by the aerifying device of the present invention. The centrifugal blower 13 of the electric motor draws air inward through the holes 23 in the base 10 and upward through the inlet tube 25 and the aperture 16 in the bottom of the blower casing 15. Such air is blown out of such casing 15 through its circumferentially spaced apertures 17 into the chamber or plenum formed by the bottom housing section 30, and out through the horizontal outlet tube 34 which can be connected to a conduit for supplying the air to a bath or tub.

The fan 14 of the motor draws a separate flow of air upward through the space between the shroud 50 and the top housing section 40. Generally upright gaskets 46, shown in FIG. 1, engaged between the wall 43 of the top housing section 40 and the wall 53 of the shroud 50 guide the incoming flow of air to the inlet apertures 19 in the top of the fan casing 18. Such air is blown down through the motor casing 11 to cool the electrical workings of the motor and is discharged into the upper plenum formed by the top housing section 40, then out through the outlet hole 44 in such upper housing portion. A generally U-shaped gasket 47 guides the outflowing air downward to the space between the upper shroud 50 and the bottom end portion of the top housing section 40 to prevent such air from immediately recirculating back through the motor.

Regardless of whether or not an obstruction occurs which prevents a full flow of air through the bottom housing section 20, cooling air continues to be supplied to the motor by the fan 14 so that it will not burn out or overheat. In addition, the bottom plenum formed by such bottom housing section is substantially sealed from the upper plenum formed by the top housing section which contains the electrical works of the motor, so that even when the motor is not operating such electrical works are not subjected to a potentially corrosive humid environment. For example, condensation may occur in the bottom housing section 30 from warm water vapor conveyed into it through the outlet tube 34 connected to the bath or tub, but condensation will not occur in the top housing section because it is sealed from the bottom housing section. Also, by positioning the main blower 13 at the bottom, water will not collect on the blower or in the area of the seal around the motor shaft 12, but rather will drip or run down out through the inlet aperture 16 of the blower casing 15.

I claim:

1. For use with a by-pass vacuum motor having:

an axial drive shaft;

electrically-powered workings for rotating the drive shaft;

blower means driven by rotation of the drive shaft and carried at one end portion thereof for supplying a primary flow of air;

a blower casing separating the electrically-powered workings from the blower means, enclosing the blower means and having an air inlet for intake of air into such casing generally axially of the drive shaft at the blower means end of the drive shaft and air outlet means for discharging air from such casing generally radially of the drive shaft; and fan means mounted outside the blower casing and driven by rotation of the drive shaft for supplying a secondary flow of air to cool the electrically-powered workings;

the improvement comprising a housing for mounting the by-pass vacuum motor with its axial drive shaft upright and its blower means at the bottom and adapting the by-pass vacuum motor for use as an aerifying device for baths or tubs, said housing comprising:

a bowl portion having an upright peripheral wall encircling the blower casing and extending downward a substantial distance below the blower casing, said bowl portion having an air inlet and an air outlet and forming a first plenum for air discharged from the blower casing; and an air inlet conduit having one end portion sealed around the air inlet of the blower casing and the other end portion sealed around the air inlet of said housing bowl portion, said air inlet conduit extending through the first plenum formed by said bowl portion for conveying air from outside said bowl portion to the blower casing air inlet.

2. The housing defined in claim 1, in which the bowl portion has a horizontal bottom extending inward from the bottom portion of the upright peripheral wall and spaced below the blower casing, the bowl portion air inlet extending through said bowl portion bottom and being registered axially of the drive shaft with the air inlet of the blower casing, and the air inlet conduit extending vertically upward through the housing bowl portion from its bottom air inlet to the air inlet of the blower casing.

3. The housing defined in claim 2, including base means beneath the housing bowl portion, mounting the housing bowl portion freestanding and spaced above the ground and having air inlet means for intake of air into said base means for entry into the air inlet conduit.

4. The housing defined in claim 1, including a dome portion extending upward from the bowl portion, encircling the fan means and the electrically-powered workings of the motor and forming a second plenum for air blown by the fan means, said second plenum and the first plenum formed by the bowl portion being substantially sealed from each other.

5. The housing defined in claim 4, in which the housing bowl portion upright peripheral wall is spaced outward from the blower casing, the dome portion including an annular flange extending inward from the top of such upright peripheral wall and having an inner edge portion sealed to the blower casing to seal the first and second plenums from each other.

* * * * *